United States Patent [19]

Muraro et al.

[11] Patent Number: 4,884,675

[45] Date of Patent: Dec. 5, 1989

[54] LINKING PROCESS AND LINKING DEVICE BETWEEN A FABRICATION MACHINE FOR ENVELOPES AND A CONDITIONING MACHINE

[75] Inventors: Pierre Muraro, Peage de Roussillon; Daniel Pernot, Saint-Clair, both of France

[73] Assignee: Garnier Ponsonnet - Vuillard S.A., Davezieux, Annonay, France

[21] Appl. No.: 69,979

[22] Filed: Jul. 6, 1987

[30] Foreign Application Priority Data

Jul. 7, 1986 [FR] France ..... 86 09847

[51] Int. Cl.[4] ..... B65G 47/10

[52] U.S. Cl. ..... 198/358; 198/347; 198/379; 198/626; 414/790.2; 414/790.3; 414/798.5

[58] Field of Search ..... 198/347, 349, 358, 379, 198/626; 414/43, 103, 104, 106, 107, 108, 109, 790.2, 790.3, 798.5; 271/177, 181, 207, 212, 218

[56] References Cited

U.S. PATENT DOCUMENTS

| | | | |
|---|---|---|---|
| 3,374,904 | 3/1968 | Francois | 271/181 X |
| 3,830,144 | 8/1974 | Kuckhermann et al. . | |
| 3,927,777 | 12/1975 | Newell | 271/181 X |
| 4,090,441 | 5/1978 | Muller | 198/626 X |
| 4,285,621 | 8/1981 | Spencer | 198/626 X |
| 4,332,124 | 6/1982 | Jaton | 271/181 X |
| 4,499,987 | 2/1985 | Long | 198/347 |
| 4,502,587 | 3/1985 | Clark | 198/347 |
| 4,625,957 | 12/1986 | DuFresne | 271/181 X |

FOREIGN PATENT DOCUMENTS

| | | |
|---|---|---|
| 2171748 | 9/1973 | France . |
| 2207455 | 6/1974 | France . |
| 1453705 | 10/1976 | United Kingdom . |

*Primary Examiner*—Robert J. Spar
*Assistant Examiner*—Lyle K. Kimms
*Attorney, Agent, or Firm*—Krass & Young

[57] ABSTRACT

The present invention relates to a process of linking the operation of a fabrication machine for envelopes and a conditioning machine by utilizing a movable device which in case of mal-functioning, may be short-circuited in favor of a classical system which is already present in fabrication machines for envelopes. This linking device is characterized by the association of an element of the chain, in particular a pivoting selection finger which, besides its task to retain the first envelopes of the subsequent lot also assures a liable guiding of the previous lot of envelopes towards the belt transporter, with a driving device for the envelopes including a mobile bar which is driven by a motor which is controlled by a counter permitting the control of the exact number of envelopes per lot, as well as the association of said two members with a pivoting distributor provided for changing the orientation of the envelopes and for disposing said envelopes in horizontal orientation onto said belt transporter comprising catch studs.

10 Claims, 7 Drawing Sheets

LINKING PROCESS AND LINKING DEVICE BETWEEN A FABRICATION MACHINE FOR ENVELOPES AND A CONDITIONING MACHINE

FIELD OF INVENTION

The present invention relates to a process and a device which permits to establish a link between a manufacturing machine for envelopes having its own manual output chain on the one hand and a totally different conditioning machine on the other hand such as to permit the grouping of the envelopes by lots as well as their transfer to the conditioning machine in fully automatic manner including a short circuit of the linkage device in cases of mal-functioning with subsequent manual discharge of the output chain, such that the operation of the fabrication machine of the envelopes is not interrupted.

The general term fabrication machine for envelopes is used here for all types of machines which produce elements of the type of envelopes for postal and non postal containments, bags and bellow type bags, disk jackets and bags for food conditioning.

PRIOR ART

At the exit of the fabrication chain is a manual discharge chain. The glued and folded envelopes which was ready for utilisation are stacked by means of a distributor device, for example of the rotating drum type having slots which are curved according to a snail-like path. In the manual discharge chain, two driving belts assure the displacement of the pile whereas a block which is mounted on the working table maintains this pile in vertical arrangement. The lots of envelopes are herewith manually punctured whereby the block is approached towards the pile which is thus the object of different conditionings.

OBJECT OF INVENTION

This working station at the end of the chain is relatively cumbersome and it is desirable to automize this operation. However, there is an important problem related to this particular technique because the fabrication must not be interrupted. The utilisation of a glue which dries rapidly as well as the plurality of fabrication lines produces considerable waste during the start up of the machine which should therefore occur as rare as possible.

SUMMARY OF INVENTION

The present invention proposes therefore a process and a device which permits,in spite of its high production rate,to establish a link between a fabrication machine for envelopes which proposes its own manual output chain with temporary stock and a conditioning station, which link assures the grouping of the envelopes by lots and their transfer towards the conditioning stations in totally automatic manner. This link is particularly characterized in that the automatic linking device, in order to avoid interruption of the fabrication machine, is short circuited in favour of the manual discharge chain in case of an accident detected by sensors on the linking device. Thus, the fabrication is not interrupted when the automatic linking device is installed. The linking device, in order to carry out the present process, is constituted by a pivoting support plate for the means for orientation and separation, a mobile bar connected to a chain which is driven by two pignons, one of which is freely mounted and the other one being driven by a motor, a buffer-compensator for the envelopes, a counter for the envelopes, a rocking finger which is controlled by said counter, a belt surveyor, a pivoting distributor with an associated conveyor of the horizontal band type with catch studs.

DETAILED DESCRIPTION OF THE INVENTION

Figure 1:
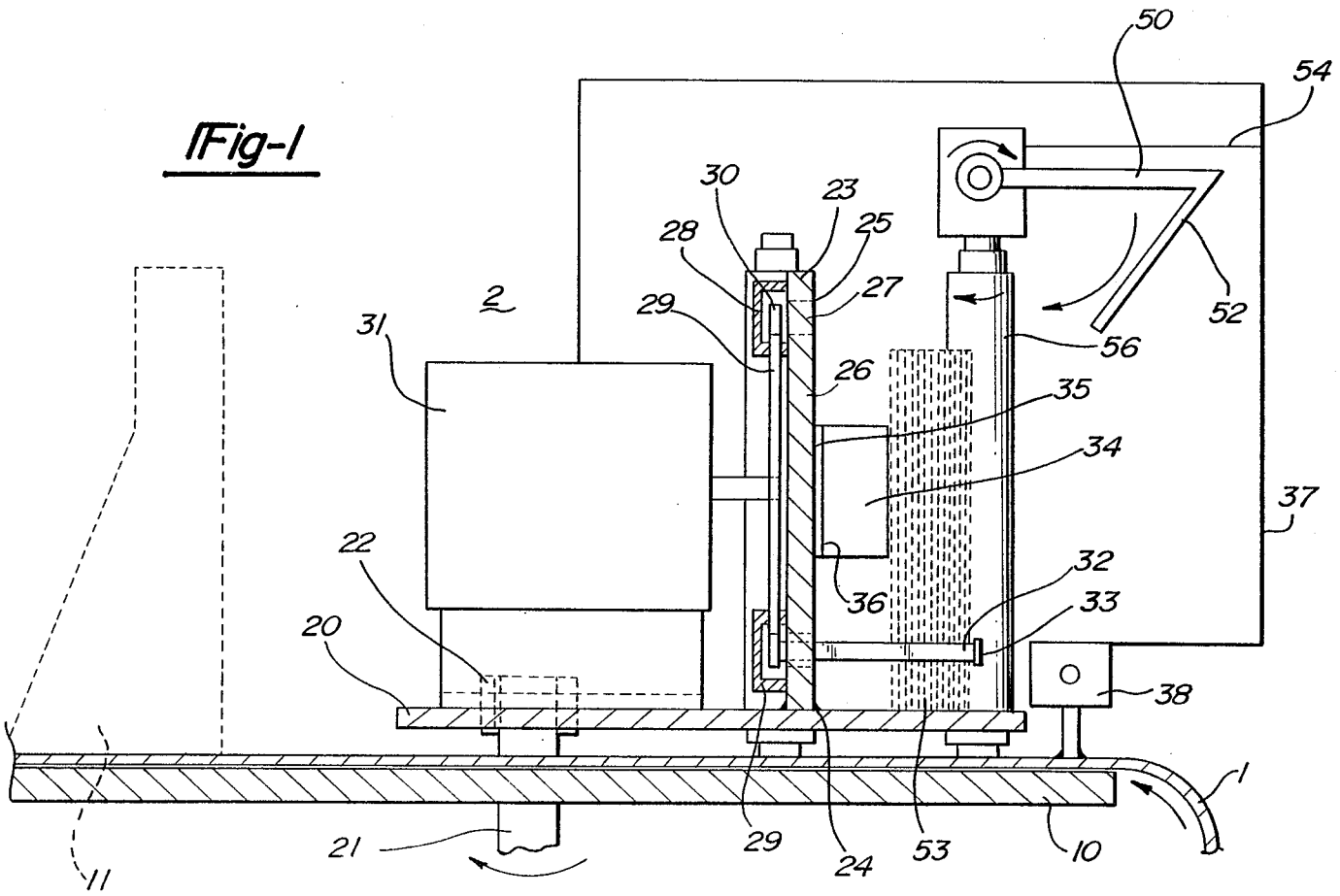
FIG. 1 is a sectional view of the orientation device according to the present invention in its working position as well as the one of the existing manual device.

FIG. 1 illustrates the device having a manual discharge chain with band transport and temporary stocking, such as it already exists in classical machines, being constituted by an assembly of two narrow bands carrying the reference number 1 in FIG. 1. This band is kept in a rotating movement whereby it is supported by the working table 10 within which a non illustrated stud11 is slidingly arranged in a grove (not shown) which functions as a stop for the maintenance of the envelopes in their vertical position. The groove can be formed in table 10 on either side of bands 1 or immediately beneath said parallel to the space separating the two bands. In a manner well-known in the art, stud 11 can be arranged to slide within the groove such that the main portion of stud 11 effectively rides just above the upper surfaces of bands 1. The linking device 2 per se is constituted by a plate 20 which is fixed on a beam 21 which rotates around a bolt 22 which is threaded into its end portion. This plate 20 comprises further a guiding plate 23 which is welded at 24 in perpendicular orientation to the pivoting plate 20. This plate 23 comprises in its central portion a longitudinal recess 25 which receives a further plate 26 of complementary profile having dimensions such that it leaves a free passage 27 between the plate 23 and plate 26 contained therein. The maintenance of this inner plate is assured by two members 28 and 29 which are positioned between the two pignons, for example 29, the object of which is to drive the chain 30 due to the motor 31. A movable bar 32 which is associated to one of the links of the chain and which carries at its end a small hat 33 of a diameter superior to the one of the bar itself is designed to carry out a closed loop movement within the free passage 27 whereby it is driven by said chain 30. The link of this bar 32 may be variable, it may be adapted to the depth of the lot of envelopes which is awaiting its conditioning. Further, during the piling of envelopes at the output of the slots 72 of the rotating drum 70. , it is necessary to maintain the first vertical ones before the rest of envelopes constituting the lot has arrived. This is the task of a compensator-buffer 34 which is constituted of a spring loaded steel plate of very small thickness which may be fastened to the plate 26 by any appropriate means such as adhesion for example at 35. In order to assume the function of a spring, the plate 34 is folded at 36. The stroke between its completely folded position and its totally relaxed position should correspond to the thickness of the defined lot of envelopes, i. e. a stroke which corresponds to the useful links of the bar 32. A counter 38 of the optoelectronical cell type permits the counting of the envelopes as they pass by. This counter comprises a link to the motor 31 such as to control the start of an operation cycle of this motor corresponding to the movement of a full loop of the chain carrying the mobile bar 32, once the number of envelopes corresponding to a lot has been attained.

Figure 2:
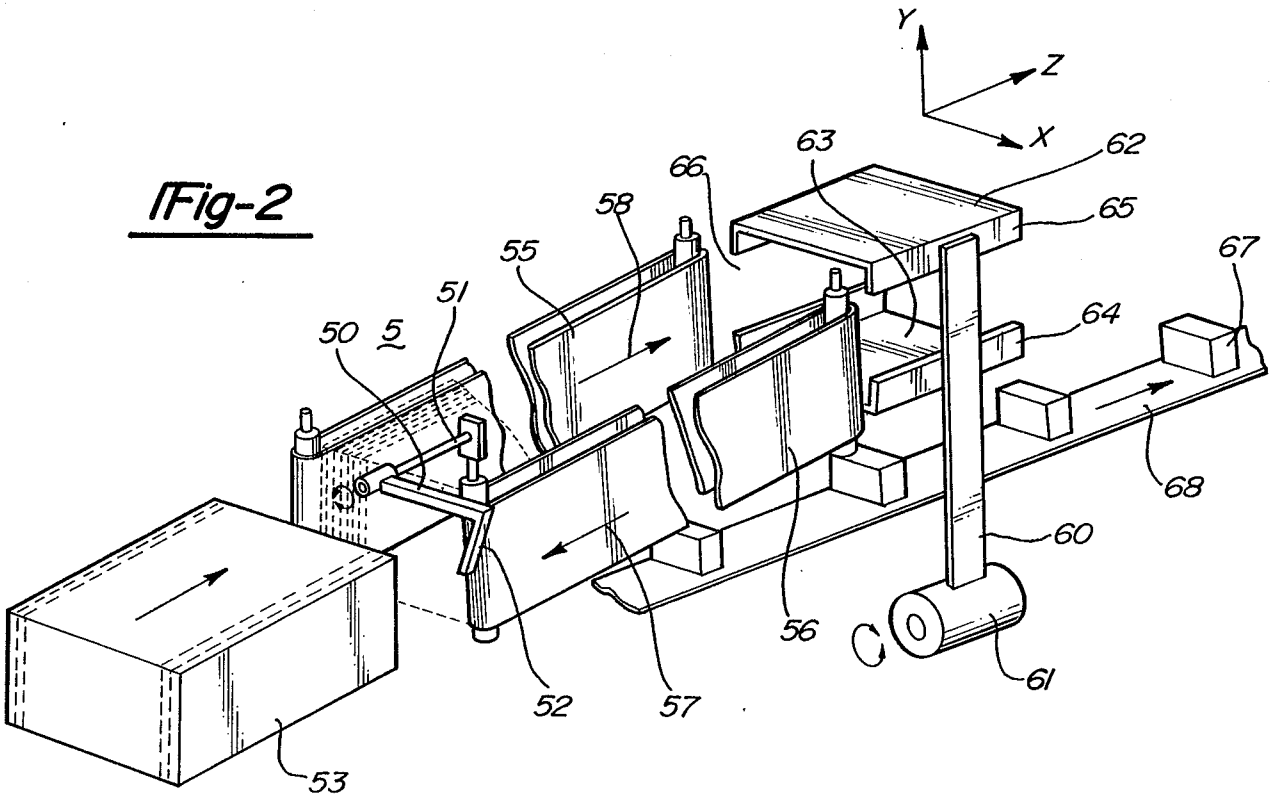
FIG. 2. is a perspective view of the pivoting distributing finger and the band conveyor.
Figure 3:
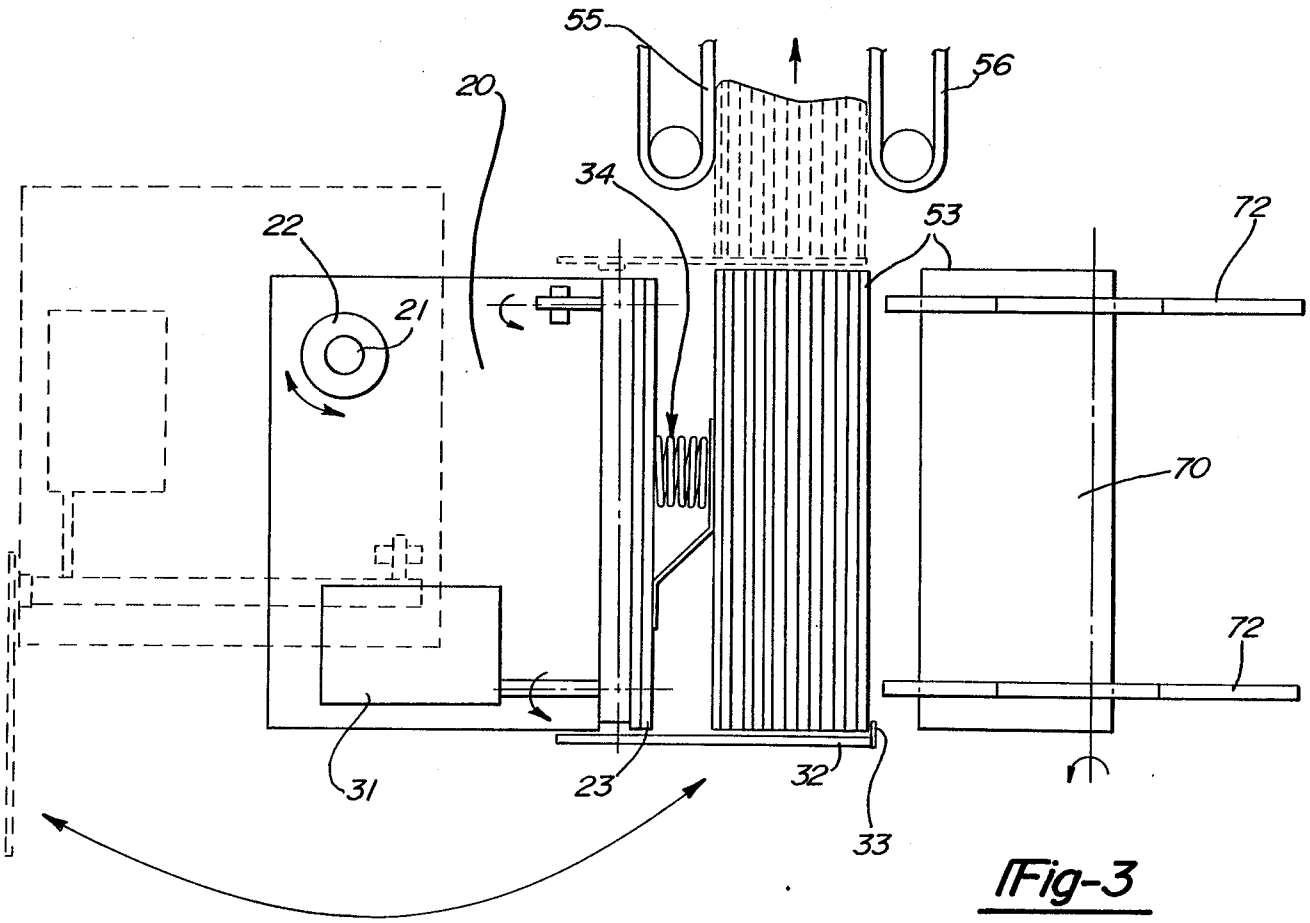
FIG. 3 is a top view of the apparatus of FIG. 1.
Figure 4:
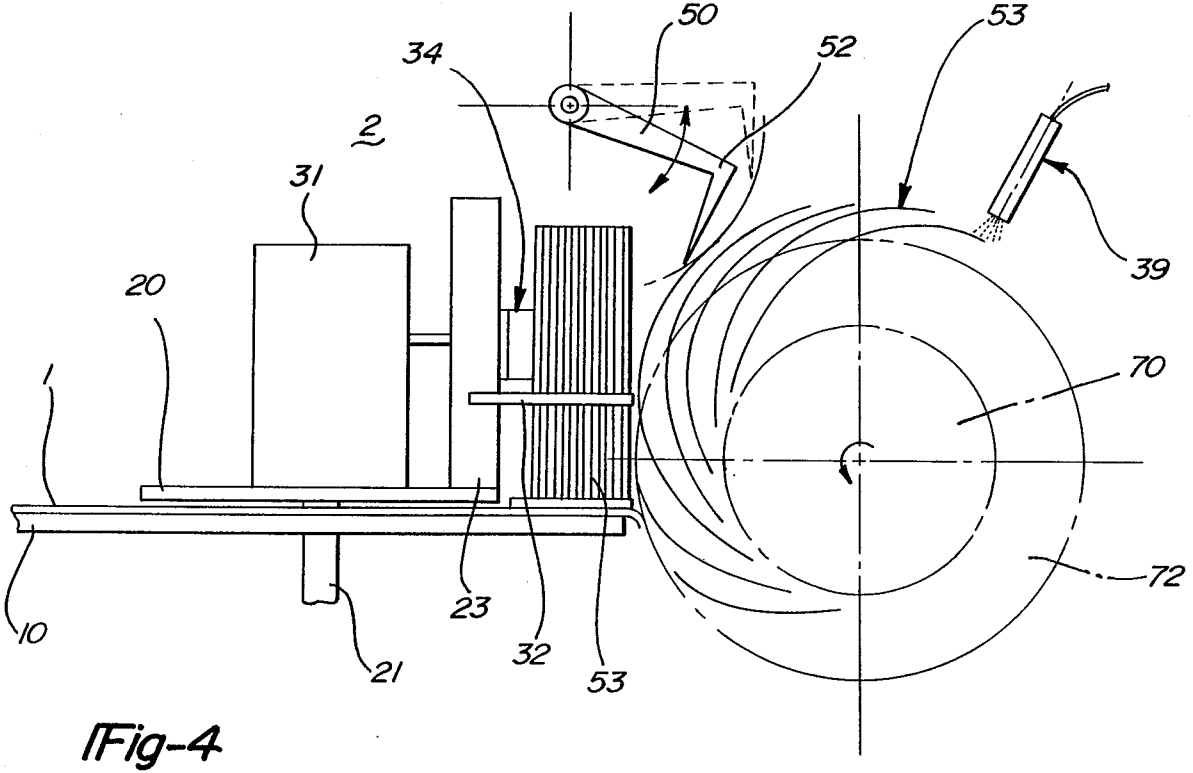
FIG. 4 is a side view of the grouping station for the envelope-type products.
Figure 5:
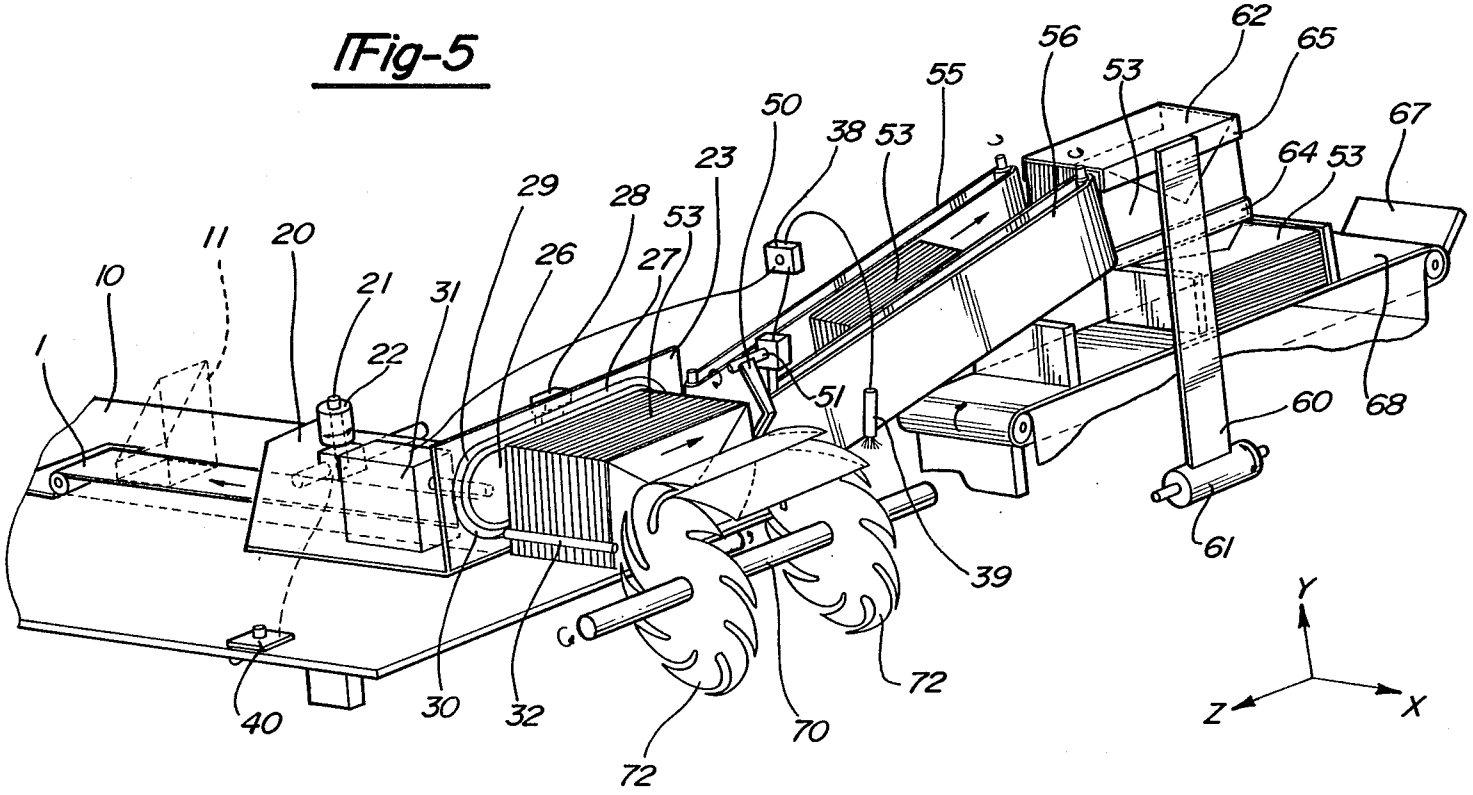
FIG. 5 is a perspective view of the entire linking apparatus which shows the automatic linking device in its operational position.
Figure 6:
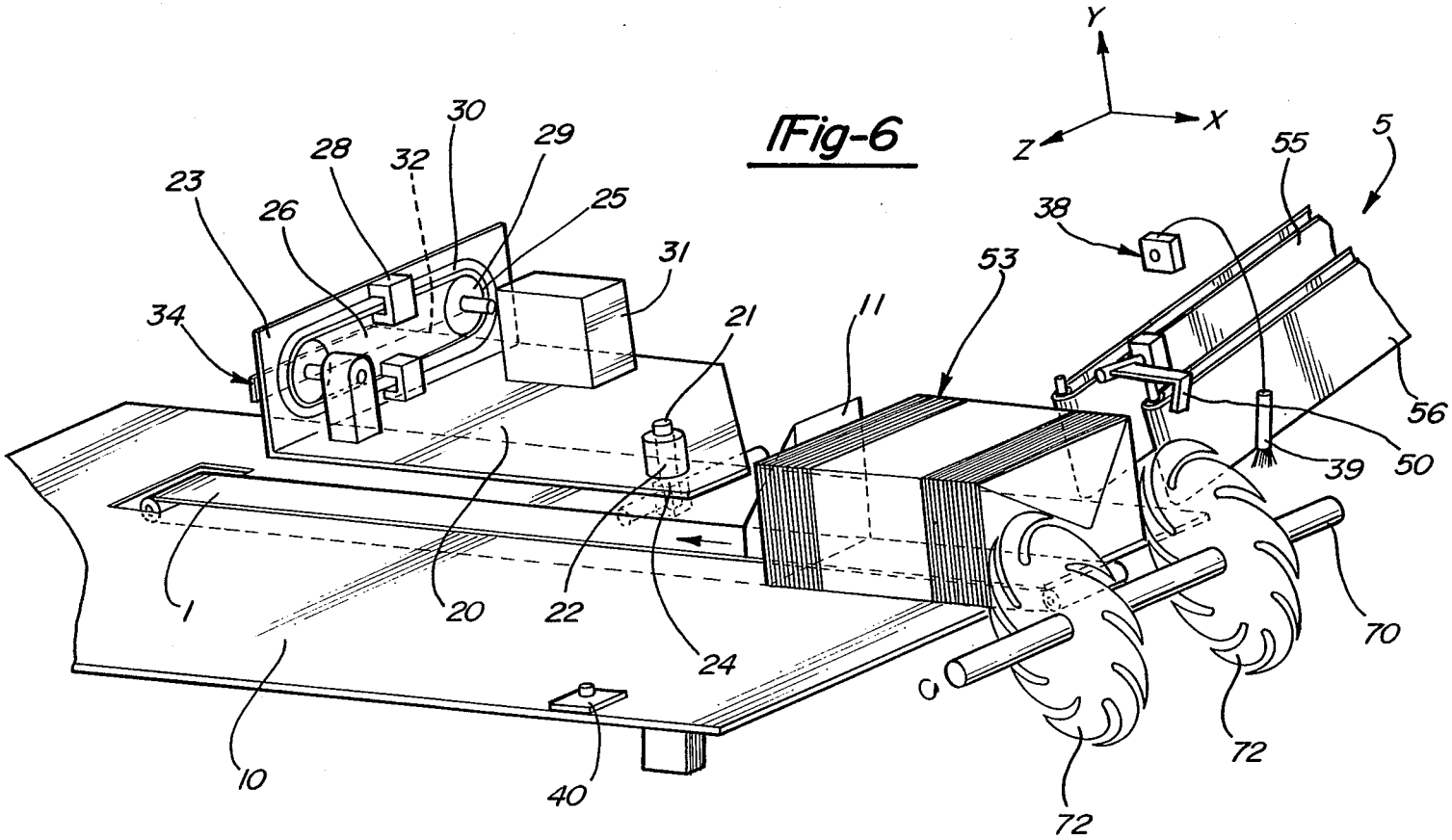
FIG. 6 is a perspective view of the linking apparatus which shows the position of the automatic linking device after it has been short-circuited in favor of the manual discharge chain.
Figure 7:
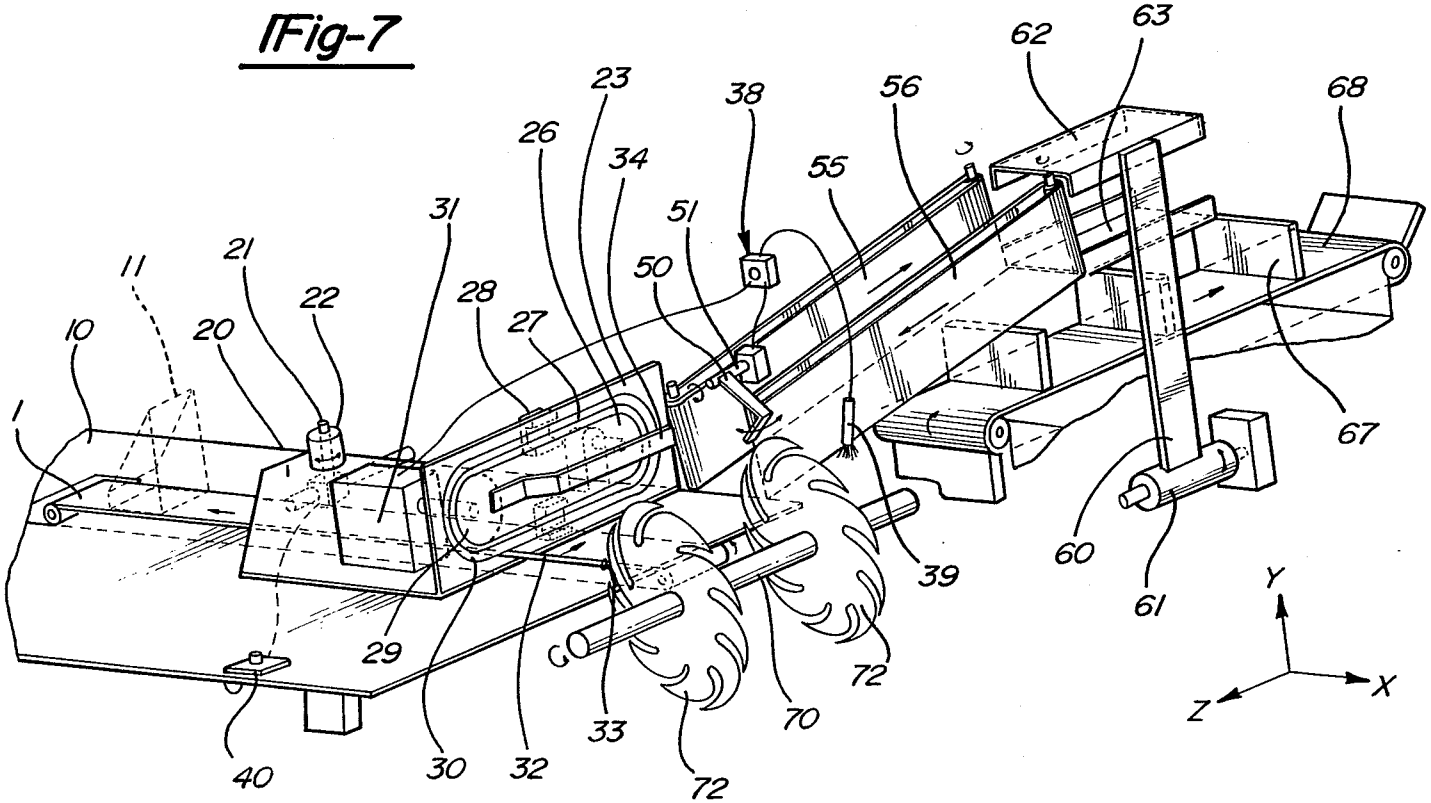
FIG. 7 illustrates the apparatus of FIG. 5 without envelopes.

Another link 54 connects the counter with the selection finger which will be described further below. FIG. 2 illustrates the discharge assembly 5 which comprises as an essential element a selection finger 50 which is set off from the front of the lot of envelopes 53 and which is pivotingly mounted on the axis 51 such that the bent back portion 52 of this selection finger 50 may abut, after rotation, onto the envelopes which are schematically illustrated at 53 at the right of the belt 56. The rotation of this selection finger is carried out by any appropriate means which is susceptible to be driven by pulses coming from the counter 38. The object of the selection finger is to abut against the last envelope of the preceeding lot and to block the envelopes of the following lot.

The belt conveyor is constituted of two separate belts 55 and 56 which are mounted such that the planes of the belts are vertically orientated whereby their movement is perfectly synchronous. The driving of each belt may be obtained by a motor-driven roll, whereby a second, associated roll may assume the role of a tensioner, whereby each belt comprises a similar couple of rolls. The passage of the belts need to be synchronous, however the directions of the rotation are inversed to one another such as to obtain the movement which is represented by arrows 57 and 58, producing a swalowing effect between the two mobile belts . At the exit of this belt conveyor there is provided a pivoting distributor 60 which is mounted on a rotating shaft 56 and which comprises two U-profiles 62 and 63 which are oriented - such that the branches 64 and 65 oppose each other, whereby their flat portions are horizontally orientated parallel to the plane of the table 10. These two U-profiles comprise a free space 66 between each other corresponding to the width of the studs 67 which are arranged on the horizontal transport belt 68, the task of which is to discharge the packages of envelopes which are horizontally disposed thereon after a 90° rotation of the distributor in order to be transported to a non-illustrated conditioning station. Such conditioning machines may be represented in different embodiments according to the product to be conditioned, such as for example an operation whereby the product is covered by a shrinkable film, or by cellophane, or otherwise the application of a simple band loop realized by a narrow band of cellulose or any synthetic material, or alternatively the deposition of those envelopes in a box.

The following is a description of the operation of a device according to the process proposed by the present invention.

The fabricated envelopes are collected at the exit of the machine by the slots 72 of rotating drum 70 which permits the vertical positioning of the envelopes which are discharge from the fabrication machine in horizontal position, whereby these envelopes are aligned on the plate 20 whereas the front face of the first envelope comes into contact with the compensator- buffer 34. Simultaneously, the counter 38 registers by means of its opto-electronical, the pulses which are created by each passage of an envelope in order to count the total and, as soon as this total attains a FIG. corresponding to the desired number of envelopes per lot, a control signal is sent to the motor 31 by line 37 which provokes the movement of the mobile bar 32 through the intermediary of the chain 30 and the pignons. The small hat 33 provides a security for the lateral seizure of the lots of envelopes. The envelopes are thus driven in perpendicular fashion by the bar 32 and slide on the mobile plate 20 and on the plate of the buffer 34. The counter has meanwhile sent, via line 54, a control signal to the selection finger 50 which pivotes as soon as the envelopes have slightly been moved forwards in a direction perpendicular to the one of the fabrication exit whereby the selection finger abuts against the external surface of the last envelope of the lot. At the same time, the first envelope of the following lot is already in place and abutting against the small hat 33 on the one hand and against the outer surface of the last envelope of the preceeding lot on the other hand. This first envelope of the following lot is driven by the friction between the two faces but this movement is blocked by the portion 52 of the selection finger 50. It is the main task of this selection finger to delimit the lots from each other and to retain the first envelopes of the following lot. Its second role is to slightly compress a lot of envelopes such as to easily introduce the latter between the two belts 55 and 56 after positionning the lots at the starting point of the first belt conveyor. The synchronous rotations in opposite directions produce an effect which leads to an insertion of the lot of envelopes into the space in between the belts and, due to the frictional forces, the envelopes are maintained in a compressed condition between the two belts such as to progress in a direction towards the pivoting distributor.

At the exit of the transport device 5, the envelopes slide into the space between he two opposing U-profiles 62 and 64, the width of which correspond to the width of the lot of envelopes. An appropriated non illustrated end detector permits to trigger a 90° movement of the pivoting distributor 60 leading it to a point above the belt conveyor 68 such that the studs may seize the lots of envelopes while they pass across the space 66 between the U-shaped profiles. In the case that an incident in the linking device according to the present invention is detected by means of a sensor 40 of a well-known type or by the operator himself, it is possible, in order to avoid an interruption of the operation and of the product flow of the fabrication machine to short-circuit the linking device in favour of a manual output chain with temporary stocking such as it exist in classical fabrication machines for envelopes. By means of the belt 1, such systems transfer the lots of envelopes which come into contact with a stop 11. The lots of envelopes can then be removed from between stud 11 and finger 50 by hand. The short-circuiting of the linking device is carried out by a rotation of the beam 21 which is fixed to the pivoting plate 20 such that only the transportation device 5 and the pivoting finger 50 remain in position.

These last mentioned, laterally set off devices do not hinder in any case the accumulation of envelopes and the utilisation of the manual system. When the linking device is again functioning properly, the stop 11 is slid out of the way and pivoting table 20 is pivoted back into position such that the automatic linking device is once again operative to handle the envelopes. During the brief interim in which stud 11 has been slid back and pivoting plate 20 has not yet been completely returned to a position where compensator buffer 34 can support the envelopes, the first or left-most envelope of the grouped lot can be temporarily supported by hand until compensator buffer 34 of the automatic device contacts the envelope.

It is understood that the present description of a particular embodiment of the invention does not limit the scope of the present invention to the above described and represented elements or their shapes. Thus the selection finger may be supported by the working table 10 or it may assume another shape such as for example a lateral piston. Equally, one may provide the transport of the envelopes by means of a chain and by a device which is positioned at the inferior portion of the plate 20 and which may be moved in a recess in the table 10. The movement of the selected lot of envelopes may also be obtained by a device comprising a hydraulical cylinder. Further, the entire operation may be controlled with respect to the pulses and the different control signals by an associated and appropriately programmed microcomputer.

The different pivoting and rocking movements may be effected by hydraulical or pneumatical cylinders.

For the fabrication of various products, such as mentioned above, the fabrication exits may be provided simply in a horizontal plane without snail, however, the device according to the present invention is applicable after appropriate orientation of the components, in particular for insertion machines.

The present invention is not limited to the embodiments which have been described above and it may be, to the contrary, subject to variations and modifications which appear to the expert in the art.

What is claimed is:

1. A linking device for automatically grouping envelope-type products into lots and for transporting the lots from a grouping station to a second location, comprising:

the grouping station;

a working table;

a cylindrical shaft extending upward from the working table and mounted thereto;

a pivoting plate rotatably mounted to the cylindrical shaft and substantially parallel to the working table, such that said pivoting plate is free of contact from said working table;

a first belt transporter;

a second belt transporter;

transfer means for transferring the lots of envelope-type products from the grouping station to the first belt transporter, comprising a mobile bar for pushing the lots sideways from the grouping station to the first belt transporter, a drive motor, a chain connected to an end of the mobile bar for transferring the motion of the drive motor to the mobile bar, and two pignons for controlling the path of motion of the chain; and short-circuiting means comprising the pivoting plate for pivotingly shifting the grouping station away from the transfer means upon occurrence of an incident in order to permit manual discharge of the lots of envelope-type products;

the grouping station supported by the pivoting plate and comprising a support plate perpendicular to the pivoting plate and means for orienting and grouping the envelope-type products into lots;

the means for orienting and grouping comprising a selection finger for grouping the envelope-type products into lots before transfer to the first belt transporter and a compensator buffer mounted on a side of the support plate and facing the lots for maintaining the lots in a position perpendicular to the pivoting plate before and during transfer;

the drive motor, chain, and pignons of the transfer means being mounted on a side of the support plate opposite the compensator buffer;

the grouping station further comprising a counter for the envelope-type products which is electronically linked to both the selection finger and the drive motor;

the first belt transporter comprising means for transferring the lots of envelope-type products to the second belt transporter;

the second belt transporter having studs for maintaining separation between the lots and comprising means for transferring the lots of envelope-type products from the first belt transporter to the second location.

2. The linking device according to claim 1, characterized in that the compensator-buffer comprises an elastic tongue having a stroke which corresponds to the width of a lot of envelope-type products.

3. The linking device according to claim 1, characterized in that the selection finger is set off from in front of the lot of envelope-type products.

4. The linking device according to claim 1, characterized in that the selection finger moves pivotally such as to move an end of the selection finger to a starting point of the first belt transporter such as to favor insertion of the envelope-type products into first belt transporter.

5. The linking device according to claim 1, characterized in that the counter is constituted by an opto-electronical cell.

6. The linking device according to claim 1, characterized in that said first belt transporter comprises independent and synchronously driven bands which are mounted in vertical planes and driven in opposite directions.

7. The linking device according to claim 6, characterized in that the distance between said two synchronous bands is slightly inferior to the width of a lot of envelope-type products in a non-compressed condition.

8. The linking device according to claim 1, characterized in that said pivoting plate may be superposed on a manual discharge chain for the envelope-type products without contacting said manual discharge chain.

9. The linking device according to claim 1, characterized in that the means for transferring the lots of envelopes from the first belt transporter to the second belt transporter comprises:

a pivoting distributor constituted of two horizontal plates of U-shaped profile arranged such that their open portions mutually oppose one another;

two substantially vertical transporting belts, each belt mounted between a driven roller and a second roller, the drive rollers rotating in opposite directions such that the inner surfaces of the two belts move synchronously with one another such as to cause passage of the lots of envelope-type products between the belts and into the pivoting distributor;

the U-shaped horizontal plates of the pivoting distributor having side branches which are aligned with the inner surfaces of the transporting belts.

10. The linking device according to claim 9, characterized in that the two U-shaped plates are positioned above the second belt transporter by a distance which permits, after a 90° pivoting movement, the passage of the studs of the second belt transporter therethrough.

* * * * *